US006363634B1

(12) United States Patent
Hangley

(10) Patent No.: US 6,363,634 B1
(45) Date of Patent: Apr. 2, 2002

(54) APPARATUS AND METHOD FOR PERMANENTLY SETTING PRE-FORMED CREASES IN PANTS

(76) Inventor: James Patrick Hangley, 331 W. Pine St., Long Beach, NY (US) 11561

( * ) Notice: Subject to any disclaimer, the term of this patent is extended or adjusted under 35 U.S.C. 154(b) by 0 days.

(21) Appl. No.: 09/620,489

(22) Filed: Jul. 20, 2000

(51) Int. Cl.[7] ..... D06F 71/28
(52) U.S. Cl. ..... 38/14; 38/1 B
(58) Field of Search ..... 38/12, 14, 1 B; 223/72, 1 B, 52, 57; 271/175; 118/306

(56) References Cited

U.S. PATENT DOCUMENTS

| | | | | |
|---|---|---|---|---|
| 4,607,589 A | * | 8/1986 | Gibson | 38/1 B |
| 4,695,485 A | | 9/1987 | Gibson | |
| 4,721,234 A | | 1/1988 | Spence | |
| 4,763,600 A | | 8/1988 | Saunders et al. | |
| 4,964,230 A | * | 10/1990 | Mai | 38/1 B |
| 5,013,378 A | | 5/1991 | Farah | |
| 5,035,199 A | | 7/1991 | Hageman | |
| 5,211,755 A | | 5/1993 | Hangley, II | |
| 5,566,480 A | | 10/1996 | Buckenham et al. | |
| 5,680,971 A | | 10/1997 | Hangley | |
| 5,692,653 A | | 12/1997 | Hangley | |

* cited by examiner

*Primary Examiner*—Ismael Izaguirre
(74) *Attorney, Agent, or Firm*—Morgan & Finnegan LLP

(57) ABSTRACT

An apparatus for setting pre-formed creases of a pair of pants comprises a base, a pair of substantially horizontal parallel support members extending from the base. An upper crease blade is mounted to each of the support members and includes an upper applicator nozzle. Each of the upper applicator nozzles is connected to a supply of setting material. A lower crease blade is movably affixed via a mechanical assembly to each of the support member and also includes a lower applicator nozzle. Each of the lower applicator nozzles is connected to the supply of setting material. The apparatus further includes a pair of actuators connected to the mechanical assemblies that are adapted to independently controllably move each of the lower crease blades relative to the upper crease blades.

A pant removal section comprises a support frame having a near end closest to the base and a far end further away from the base, a trolley assembly including a slider block associated with the support frame and adapted for reciprocal movement along a guide rail in a predetermined path, a pair of grippers attached to the trolley, and a controller adapted to coordinately control movement of the trolley assembly and actuation of the gripper, and supply of the setting material to the upper and lower applicator nozzles.

When a pair of pre-creased pants are slipped over the crease blades, the lower crease blades are moved downwardly, away from the upper crease blades until the pants are pulled taut at the hems. The pants are then gripped by the grippers at the cuffs and slid in a generally horizontal direction off of the apparatus. As the pants are removed, a flowable, curable setting material, such as silicone rubber is supplied to the applicator nozzles to coat the inside surfaces of the pant legs along the creases.

20 Claims, 4 Drawing Sheets

98
94
92
96
90
56
54
52
50
25
34
36
26

APPARATUS AND METHOD FOR PERMANENTLY SETTING PRE-FORMED CREASES IN PANTS

BACKGROUND OF THE INVENTION

1. Field of the Invention

The present invention relates to an apparatus and method for permanently setting pre-formed creases in a pair of pants. In particular, the present invention relates to an improved apparatus for applying a flowable curable setting material to the inside surface of the pants along pre-formed creases.

2. Description of the Related Art

At least two automated apparatuses for permanently creasing pants are known in the art. One such apparatus is disclosed in U.S. Pat. No. 4,607,589, issued Aug. 26, 1986 to Gibson, the disclosure of which is incorporated herein by reference. The Gibson apparatus comprises at least one vertical arm capable of insertion into a leg of a pair of pants, an applicator head located at an end of the arm for application of a crease setting composition, a guide means for locating the nozzle within the crease to the treated. In use the pants are lowered over the arms and the arms are moved apart to locate the applicator heads within opposing creases. The pants are then moved upwardly drawing the applicator heads down the pre-formed crease lines of each pant leg. However, the Gibson '589 apparatus provides inaccurate resin application and is extremely complex in practice. It is not typically used in production.

Another such apparatus is disclosed in U.S. Pat. No. 4,763,600 to Saunders et al., the disclosure of which is incorporated herein by reference. The Saunders —600 apparatus comprises a base, a pair of horizontal support members extending from the base, and lower and upper crease blades pivoted on the support member. The free ends of the crease blades extend away from the support member and include applicator nozzles that are directed upward for the upper crease blades and downward for the lower crease blades. The horizontal crease blades of the Saunders —600 patent permit the entire crease length to be positioned along the upper crease blade prior to resin application. When the apparatus has received a pair of pre-creased pants over the crease blades and the lower crease blades are pivoted downward, the pants are pulled taut at the hems between the pre-formed creases and as the pants are pulled off of the crease blades, a pumping mechanism supplies a flowable, curable setting material such as silicone rubber to the applicator nozzles, which applies a coating of setting material to the inside surfaces of the pants along the creases.

However, manual pant removal of the Saunders —600 patent can cause uneven application of the resin if removal of the pants is sped up or slowed down. Also, the use of one actuator for the two crease blades requires exact positioning of the pants, and in production work this is not practicable.

Further, because the Saunders —600 patent depends upon movable crease blade assemblies with short single pivot points, there tends to be a great variation in the relative axial location of lower applicator nozzle and the upper applicator nozzle. Accordingly, the end of the pants passes the applicator nozzle of the lower crease blade some time before it would pass the applicator nozzle of the upper crease blade. This design further results in the lower applicator nozzle being arranged at a non-perpendicular angle, relative to the fabric.

SUMMARY OF THE INVENTION

Thus, what is disclosed is an apparatus for permanently setting pre-formed creases in pants. The apparatus comprises a pair of substantially horizontal parallel support members extending from a base, an upper crease blade mounted to each one of the support members, an upper applicator nozzle mounted to each of the upper crease blades and connected to a supply of setting material, a lower crease blade movably affixed via a mechanical assembly to each of the support member, a lower applicator nozzle mounted to each of the lower crease blades and connected to the supply of setting material, a pair of actuators connected to the mechanical assemblies, each of the actuators adapted to controllably move a one of the lower crease blades relative to the upper crease blades; and a controller adapted to coordinately control movement of the lower crease blades and supply of the setting material upon activation.

Optionally, the apparatus may also include a pant removal section. This section includes a support frame having a near end closest to the base and a far end further away from the base. A trolley assembly having a slider block is associated with the support frame and adapted for reciprocal movement along a guide rail in a predetermined path. A pair of grippers are attached to the trolley. A controller is adapted to coordinately control movement of the trolley assembly and actuate of the gripper. The controller also regulates the supply of the setting material to the upper and lower applicator nozzles.

According to one aspect of the invention, in the creasing section each of the mechanical assemblies comprises a control arm having a near end and a far end in relation to the base and the lower crease blade being pivotally affixed to the control arm at the far end. The control arm is further pivotally affixed to the horizontal support member at a pivot point between the near end and the far end. Each of the actuators is connected to a one of the control arms at the near end and adapted to pivot the control arm about the pivot point. Preferably, the location of the pivot point is chosen so that a ratio of a distance between the far end and the pivot point to a length of the control arm is between about ⅓ and about ¾, and most preferably the ratio is about two-thirds (⅔).

According to another aspect of the invention, the mechanical assembly is adapted to move the lower crease blade as a whole in a substantially downward direction.

According to a further aspect of the invention, each of the actuators comprises a pressure cylinder mounted on the base. Preferably, the actuators are air cylinders.

According to a still further aspect of the invention, one or more valves regulate the supply of resin to the applicator nozzles. Preferably, there are two valves and each of the valves independently controls the supply of the setting material to a one of the applicator nozzles. One valve controlling the two upper facing nozzles and one valve controlling the two lower.

According to another aspect of the invention, a sensor on the support member is configured to detect the presence or absence of a pair of pants and may and to detect the passing of a waistband the pair of pants. Preferably, the sensor is a photo eye mounted on a sensor support affixed to the horizontal support member.

According to a further aspect of the invention, the nozzle has the shape of an elongated oval.

According to a still further aspect of the invention, the upper crease blades have a straight top edge.

According to another aspect of the invention, in the pant removal section, a manually operated switch associated with the controller is provided that is adapted to activate the controller once a pair of pants are placed over the horizontal support members. Preferably, the manually operated switch is a foot switch.

According to a further aspect of the invention, one or more magnetic reed switches are provided along the guide rail and adapted to detect the location of the trolley assembly. The controller, informed by the switches of the relative positioning of the trolley, coordinately controls the application of the resin to the creases and the position of the crease blades.

According to a still further aspect of the invention, a pair of U-shaped brackets mounted on the trolley, each bracket having a short leg and a long leg; an air cylinder mounted between the short legs and long legs of the pair of U-shaped brackets, the air cylinder being affixed to the short legs of the pair of U-shaped brackets, the cylinder including a push rod which defines an axis perpendicular to the axis of the long legs of the U-shaped brackets; and a plate mounted on the push rod and defining a plane parallel to a plane defined by the long legs of the pair of U-shaped brackets. Upon activation, the push rod is adapted to move along the perpendicular axis.

According to another aspect of the invention, a DC gear motor mounted to the support frame including a drive shaft having a first pulley mounted thereon; a second pulley mounted on the support frame; a toothed belt suspended between the first pulley and the second pulley; and a support block affixed to the toothed belt upon which the gripper is attached. The first pulley may be arranged with respect to the second pulley so that the belt defines a plane with a downward slope or a substantially horizontal slope.

There is also provided an apparatus for permanently setting creases in pants comprising means for substantially horizontally supporting a pair of pre-creased pants; means for independently pulling each one of the pants taut at the hems between the pre-formed creases; and means for applying a flowable, curable setting material to the pre-creases in the pants while controllably removing the pants.

There is further provided a method of permanently setting creases in pants. The method comprises providing pants which are pre-creased; providing a support including a pair of fixed upper crease blades and a pair of lower crease blades pivotally mounted on the support, independently actuating a pair of the lower crease blades to pull each of the pant legs taut; applying a flowable, curable setting material to the pre-creases in the pants while controllably removing the pants.

The apparatus and method of the invention will be more readily understood and apparent from the following detailed description of the invention when read in conjunction with the accompanying drawings, and from the claims which are appended at the end of the detailed description.

DETAILED DESCRIPTION OF THE PREFERRED EMBODIMENTS

Figures 1, 2:
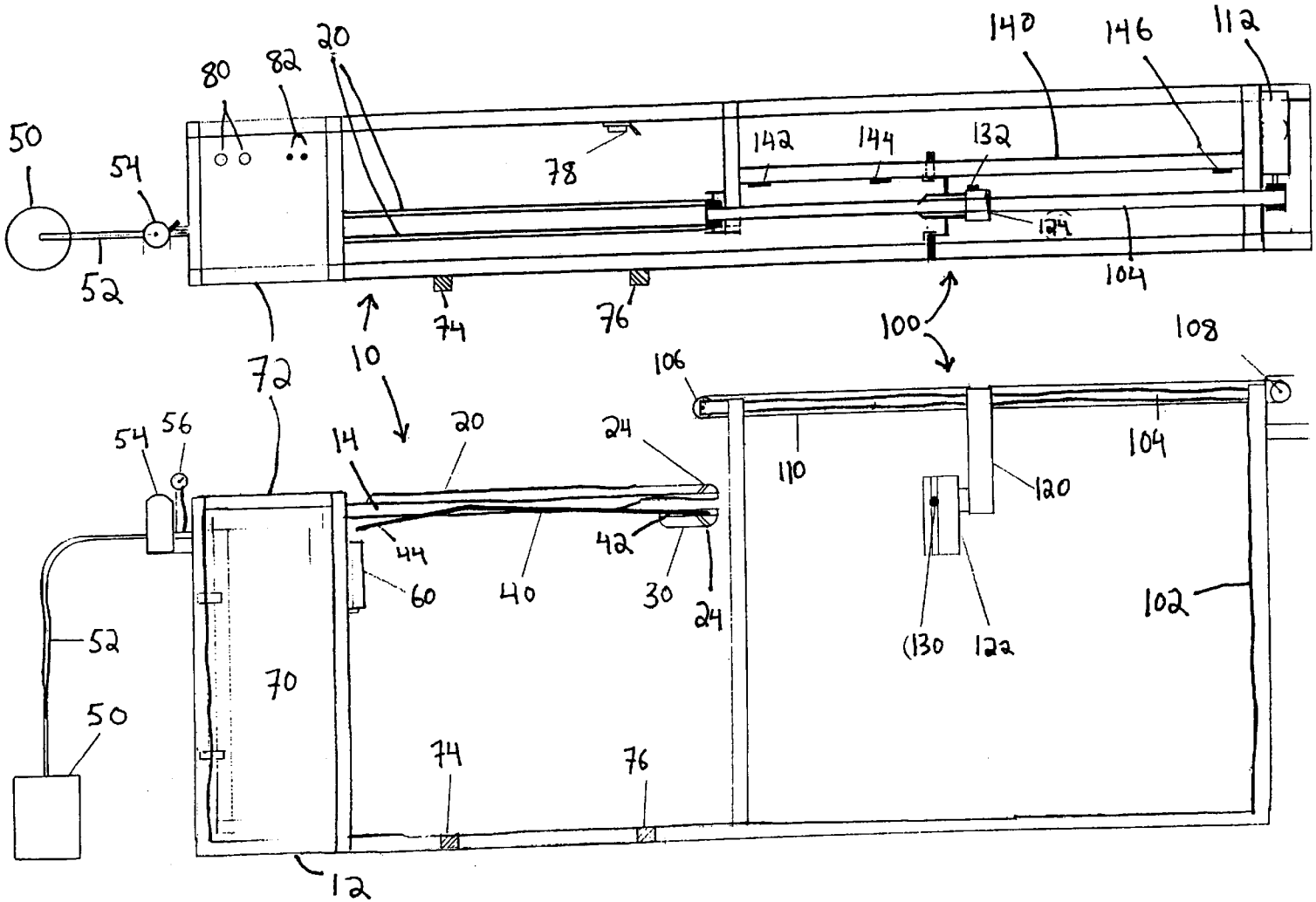
FIG. 1 is a side elevation of an embodiment of the present invention.
FIG. 2 is an overhead view of an embodiment of FIG. 1.

FIG. 1 illustrates a side elevation of an embodiment of the present invention. The embodiment includes a creasing section 10 and a removal section 100. The creasing section is adapted to receive pre-creased pants (not shown) on a pair of supports 14 and to apply a small amount of a setting material or resin to the inside of the pants, along the crease. The removal section 100 is adapted to remove the pants from the creasing section 10.

The creasing section 10 includes a pair of supports 14. As shown, these supports 14 extend substantially horizontally from a base 12. Affixed to each the supports 14 is an upper crease blade 20 having an upper edge 22 that is adapted to fit into a crease of the pre-creased pants. Preferably, the upper crease blade is rigidly fixed to the support 14. A fixed upper crease blade 20 permits the operator to position the pre-formed crease along the entire length of the crease blade 20. By maintaining the crease on the upper crease blade 20, the operator ensures exact application of the resin to the crease. Preferably, the upper edge 22 is straight.

Each of the upper crease blades 20 also has a nozzle 24 at the end thereof The nozzle 24 is connected to a supply of setting material. In the shown embodiment the setting material is found in a pail 50. The nozzle 24 is adapted, as explained below, to apply a small amount of the setting material into the crease of the pant.

The crease setting composition should be a flowable, curable material and is chosen to permanently set the creases into the pants upon curing of the material. The setting material preferably is an oxime type, an acetic acid type, or a multiple-component self-catalyzing type silicone rubber compound or other similar material that partially cures to a non-tacky texture in approximately 20 minutes at room temperature and completely cures in approximately 8 hours at room temperature and normal relative humidity. Examples of such compounds include latex, thiskol polyurethane resin, and silicone rubber. It will be apparent to those skilled in the art that other creasing materials can be used by the apparatus described herein.

Figure 3:
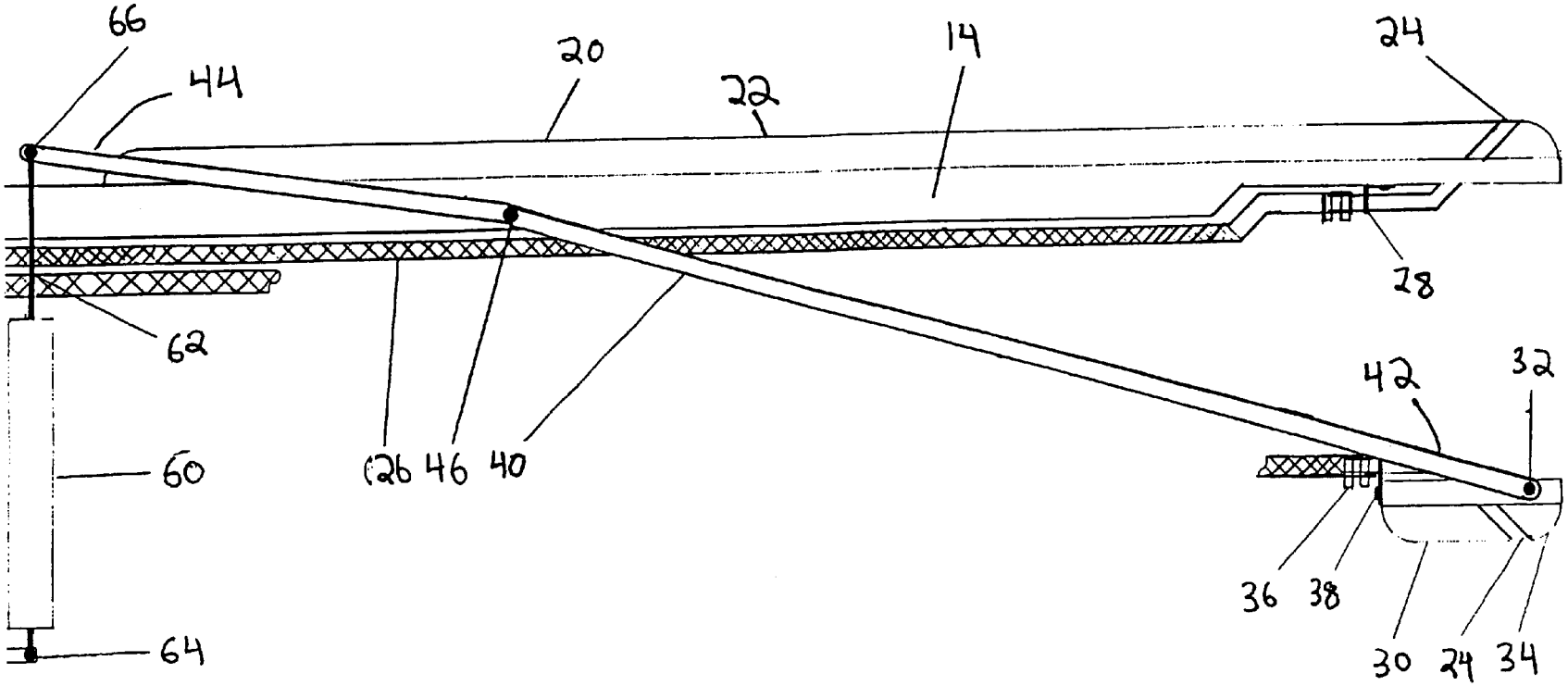
FIG. 3 is a detail of a portion of the creasing section of FIG. 1.

The setting material is supplied to the nozzle 24 by a hose 26 via a nozzle mount 28 as shown in FIG. 3. The hose 26 is attached to a material regulator 54 having a flow meter or gauge 56 attached thereto. The hose 26 may also be attached to an on/off valve controlling resin flow. The material regulator 54 is, in turn, connected with a pail 50 via a pipe 52. A pump in the pail 50 supplies—the setting material to the pipe 52. Alternately, suction could be applied at the material regulator 54 or anywhere along pipe 52 or hose 26 to draw the setting material from the pail 50.

In the shown embodiment, each of the supports 14 also includes a lower crease blade 30 mounted to an end 42 of a control arm 40. The control arm 40 is pivotally affixed to the support 14 about a pivot point 46. Preferably, the location of the pivot point is chosen so that a ratio of a distance between the far end and the pivot point to a length of the control arm is between about ⅓ and about ¾, and most preferably the ratio is about two-thirds (⅔). Accordingly, by movement of the control arm 40, the lower crease blade 30 may be moved in a generally downward direction relative to the upper crease blade 20. This avoids or reduces movement of the nozzle 24 in the axial direction (along the length of the supports 14).

An alternative embodiment, not shown, includes a mechanical assembly adapted to move the lower crease blade as a whole in a substantially downward direction, rather than pivot the blade in a downward direction. Such an mechanical assembly might include a pair of crossed members that are pivoted at a center point. The center point is rigidly fixed relative to the horizontal support member 14. The upper ends of these crossed members could be slideably affixed to the horizontal support member 14. The upper ends of these crossed members could be slideably affixed to the lower crease blade 30. Such an arrangement permits substantially downward movement of the lower crease blade 30 by sliding of each of the crossed members in a horizontal direction away from the other crossed member. Numerous other mechanical assemblies are also possible which achieve substantially downward movement of the lower crease blade 30.

Each of the control arms 40 is independently actuated. A second end 44 of the control arm 40 may be attached to a piston shaft 62 of an air cylinder 60. The air cylinder 60 moves the lower crease blade 30 downward by extending the piston shaft 62. Alternatively, as would be understood by one of skill in the art, the linkage between the air cylinder 60 could be constructed (in a manner not shown) to move the lower crease blade 30 downward by contracting the piston shaft 62. Also, the upper crease blade could be affixed to the support 14 in a manner that permitted movement in a generally upward direction.

"Independently controlled" means that a left one of the lower crease blades 30 is controlled by, for example, one air cylinder 60 and a right one of the lower crease blades 30 is controlled by a second air cylinder 60. This permits the left lower crease blade 30 to be lowered at a faster rate than the right lower crease blade 30.

Independent control provides a means for correcting discrepancies in positioning of the pant legs. Conventionally, pant legs get wider up toward the body of the pants. If the crease blades are not independently controlled, both lower crease blades 30 are maintained at the exact same downward height. In this instance, when the pant legs are removed unevenly—as is often the case—one lower crease blade 30 would not make contact with the inside of the pre-creased pants.

Actuation of the control arms and application of the setting material may be automatically controlled or manually controlled. For example, a controller 70 for controlling the movement of the crease blades 30 and 20 may be provided in a control cabinet 72 of the base 12.

The controller 70 may be configured to sequence the output based on the input. For example, a Programmable Logic Controller (PLC) 70 receives inputs from magnetic reed switches 142, 144 and 146, photo eyes 78, and foot switches 74 and 76. The controller 70 then generates an output signal to control a DC motor drive 112, electro/pneumatic solenoids which in turn activate air cylinders 60, gripper cylinders 134, and resin control valves 94 and 96. Timing delays may be added as needed to create the desired functionality. Foot pedals 74 and 76 may be provided to allow an operator to manually trigger movement of the control arms and application of the setting material to the pants. The details of the method of operation of the creasing section 10 are described in below.

The removal section 100 is disposed to receive the pants from the creasing section 10. In the shown embodiment, the removal section 100 is adjacent to the creasing section 10. The removal section 100 includes a frame 102. As shown, the frame 102 is attached to the base 12 of the creasing section 10. This is optional and the frame 102 can be entirely self supporting. A top the frame 102 is a linear guide rail 104 which runs substantially horizontally, as shown.

Mounted to the frame 102 is a front pulley 106 (at the end closest to the creasing section 10) and a rear pulley 108 attached to the motor 112 (at the end furthest from the creasing section 10). A drive belt 110 spans between these pulleys 106 and 108. A gripper 130 is mounted to the driver belt 110 via a hanger 120. Movement of the hanger 120 is caused by movement of the drive belt 110 on the pulleys 106 and 108. Optionally, the front pulley 106 may arranged with respect to the rear pulley 108 so that the belt 110 defines a plane with a downward slope.

The gripper 130 is affixed to the hanger 120 by a mount 122. The details of these elements are described below in FIGS. 7A–B. Most generally, the gripper assembly 130 is adapted to grip the cuffs of the pants and to pull the pants from the creasing section 10. The details of the method of operation of the removal section 100 are described in below.

Optionally, a controller is used to coordinate the many parts of the removal section. This controller would control the reciprocal movement of the gripper 130 along the guide rail 104, receive positioning information regarding the gripper 130 and control the gripping and release of the gripper 130 itself. It should be understood this controller may be a separate removal controller (not shown) or may be the controller 70 that is also used to control the creasing sections.

FIG. 2 illustrates an overhead view of an embodiment of FIG. 1. Starting with the creasing section 10, the two upper crease blades 20 are shown attached to the base 12. Additionally, mounted to the frame 102 is a photo eye with right angle mirror 78. The photo eye 78 shoots a light beam to a reflective material along the outside of a upper crease blade 20. The photo eye detects the reflection of this light beam. If it is not detected, there is an object present in the light beams path.

The photo eye 78 is disposed to detect the presence of a pair of pants on the support member 14 and to provide a trigger for enabling operation of the apparatus. For example, the photo eye 78 may detect the presence of the pants (i.e., when the photo beam is broken). This information may be transmitted to the controller 70, which may be configured to only allow the apparatus to operate when, for example, a foot switch 74 or 76 is pressed and pants are present.

The photo eye 78 may also detect the passing of the waistband of the pants. This information may be transmitted to the controller 70. The controller 70 may be configured to terminate the pumping of curable setting material to the nozzles 24. In this manner, the photo eye 78 may act as an Enable/Off switch for the apparatus.

In this manner, application of the setting material may be controlled once the pants are detected on the supports 14 and ceased once the waistband passes the pre-selected point.

Atop of the cabinet 72, ports may be provided to ease operation. For example, shown are air and electric ports 80 and glue test switches 82. Air and electric ports 80 allow ease of hook up to factory electric/air systems.

The glue test switches 82 allow the operator to manually turn on the resin/glue flow. Typically, the setting resin is an air curable resin, which hardens when exposed to moisture. To prevent unwanted curing of the resin in the nozzles 24 when the apparatus is not in use, plugs (not shown) may be inserted into the nozzles 24 when the apparatus is not in use. However, these plugs push the resin away from the nozzle tip and toward the hoses.

Whenever the operator restarts the apparatus, plugs are removed and the glue test switches 82 are activated. This also ensures that the glue is at the tip of the nozzles 24.

In the removal section 100, a linear runner block 124 with a magnet 132 is shown. Magnetic switches 142, 144 and 146 are located on a support 140 parallel to the linear guide rail 104. These switches detect the passing of the linear runner block 124. This information may be conveyed to the controller 70 to provide a means of coordinately controlling the removal section 100 and the creasing section 10. Instead of magnetic switches, proximity switches, or micro switches could be used.

Also shown in FIG. 2 is a gear motor 112. This motor is mounted to the frame 102 and is configured to drive the drive belt 110. As discussed above, movement of the drive belt causes movement of the linear running block 124 and therefore movement of the gripper assembly 130.

FIG. 3 is a detail of a portion of the creasing section 10 having a support 14, an upper crease blade 20 and a control arm 40 having a lower crease blade 30. An upper crease blade 20 is shown having a nozzle 24 at the end thereof. The nozzle 24 connected to a supply of setting material via a hose 26. The hose 26 is connected to the nozzle 24 via a nozzle mount 28.

The lower crease blade 30 includes a front fin 34 and a nozzle 24. The front fin 34 may be rounded in shape. This permits the pants to slide on smoothly. The nozzle 24 connected to a supply of setting material via a hose 26. The hose 26 is connected to the nozzle 24 via a clamp 36 and a screw 38.

The lower crease blade 30 is pivotally mounted to end 42 of the control arm 40 at a pivot point 32. As shown, the pivot 32 need not be concentric with the lower crease blade 30. By pivotally mounting the lower crease blade 30 to the control arm 40 the nozzle 24 located in the crease blade 30 can more easily follow the contour of the back crease of the pair of pants as they are slid past the nozzle 24.

Movement of the lower crease blade 30 is controlled by, for example, an air cylinder 60. It should be understood that other means for moving the control arm 40 are possible. For example, an oil cylinder may be used. Alternatively, an electric motor with pinion drive or even a spring could also be used.

The control arm 40 is pivotally mounted to the support 14 at a point between its ends 42 and 44. The air cylinder 60 is linked to the control arm 40 via a piston shaft 62 of the cylinder 60. Because of this arrangement, the lower crease blade 30 may be moved in a generally downward direction by extension of the piston shaft 62 and the resulting pivot of the control arm 40. As shown in FIG. 3, the air cylinder 60 is pivotally mounted to the base 12 by a bottom pivot mount 64 and is pivotally mounted to the control arm 40 at a top pivot mount 66. This permits the lower crease blade 30 to move in a downward direction increasing the separation between the upper 20 and lower crease blades 30 as the pants are being removed.

Figures 4, 5, 6:
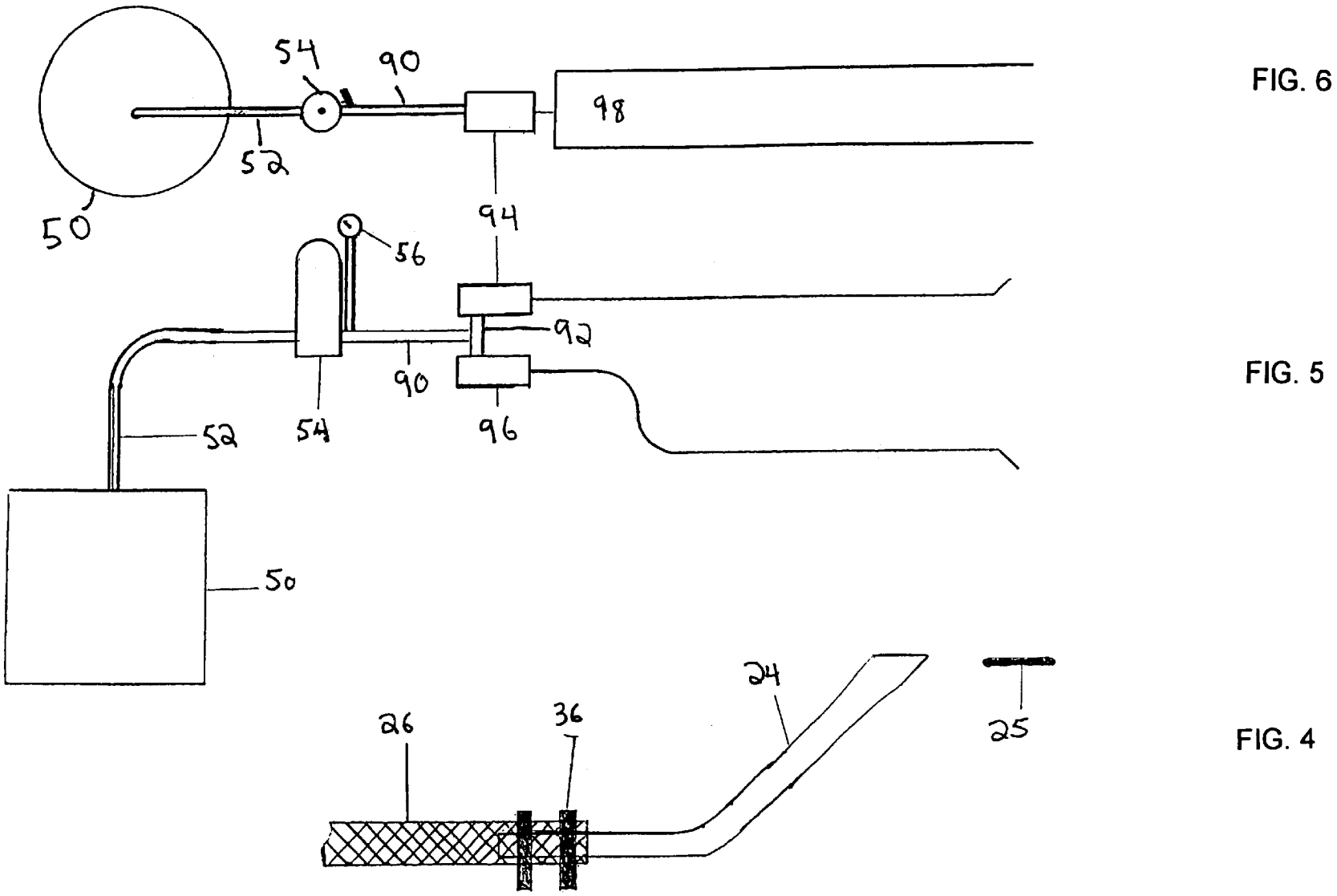
FIG. 4 illustrates a section of the nozzle assembly of FIG. 1.
FIG. 5 illustrates a side elevation of the material handling portion of the creasing section of FIG. 1.
FIG. 6 illustrates an overhead view of the material handling portion of FIG. 5.

FIG. 4 illustrates a section of the nozzle assembly having a nozzle 24 secured to a hose 26 by means of a clamp 36. The nozzle 24 preferably formed as an oblong slit 25. One method of manufacturing such a nozzle 24 is by first obtaining a conduit having a circular cross section. Preferably, the diameter of the cross section is roughly equal to the inner diameter of the hose 26. Second, one end of the conduit is inserted into the hose 26 and the clamp 36 is applied to secure the conduit. Then the other end is compressed radially inwardly from two opposing sides to form an oblong slit 25 as shown. The conduit may be bent (shown) or straight.

FIG. 5 illustrates a side elevation of the material handling portion of the creasing section. A pail 50 is shown feeding to a material regulator 54 via a pipe 52. Then, the material regulator 54 feeds into a pipe 90, which then splits and via a tee 92 feeds into a top snuff back valve 94 and a bottom snuff back valve 96. Snuff back valves 94 and 96 are on/off valves controlling the resin flow. The resin is often a synthetic rubber, which may continue to flow even after ordinary control valves are shut off. Snuff back valves 94 and 96 are designed to "suck" back an amount of resin when shut off. This also prevents resin from protruding out of the nozzle 24 when the pants are pulled on or off the apparatus and thereby prevents unsightly resin stains on the pants.

Along pipe 90 a gauge 56 is disposed to measure the flow rate of the setting material. This gauge 56 allows precise metering of the amount of resin. Another way to control the desired amount of resin is by increasing/decreasing the size of the nozzle opening.

The top snuff back valve 94 feeds the nozzles 24 (not shown) of the two upper crease blades 20. The bottom snuff back valve 96 feeds the nozzles 24 (not shown) of the two lower crease blades 30.

FIG. 6 illustrates an overhead view of the material handling portion of FIG. 5. Again the pail 50, the pipe 52, the material regulator 54, the gauge 56 and pipe 90 are shown. The top snuff back valve 62 is also shown. Additionally tee 98 is shown conveying the setting material from the top snuff back valve 94 to both the right and the left upper crease blades 20.

It should be understood that it is also possible that the setting material could be supplied to the upper and the lower crease blades independently. Alternately, each of the crease blades could be provided with its own supply of setting material.

Figure 7B:
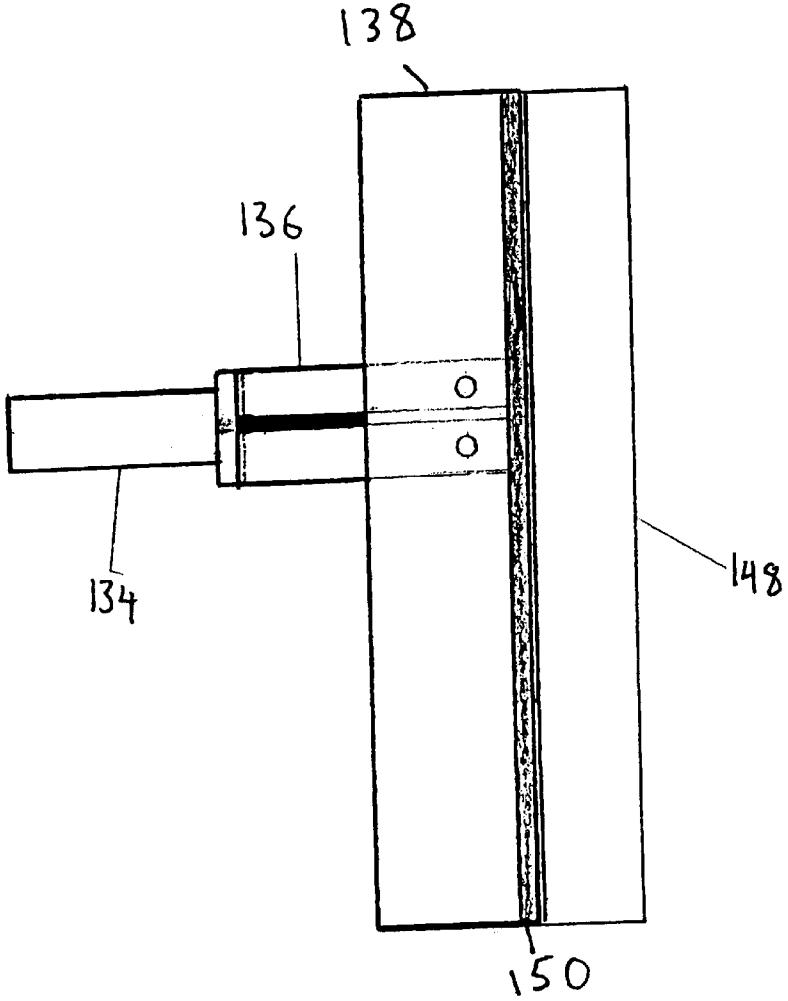
FIGS. 7A and 7B show the gripper assembly in the open and closed positions, respectively of the removal section of FIG. 1.
Figure 7A:
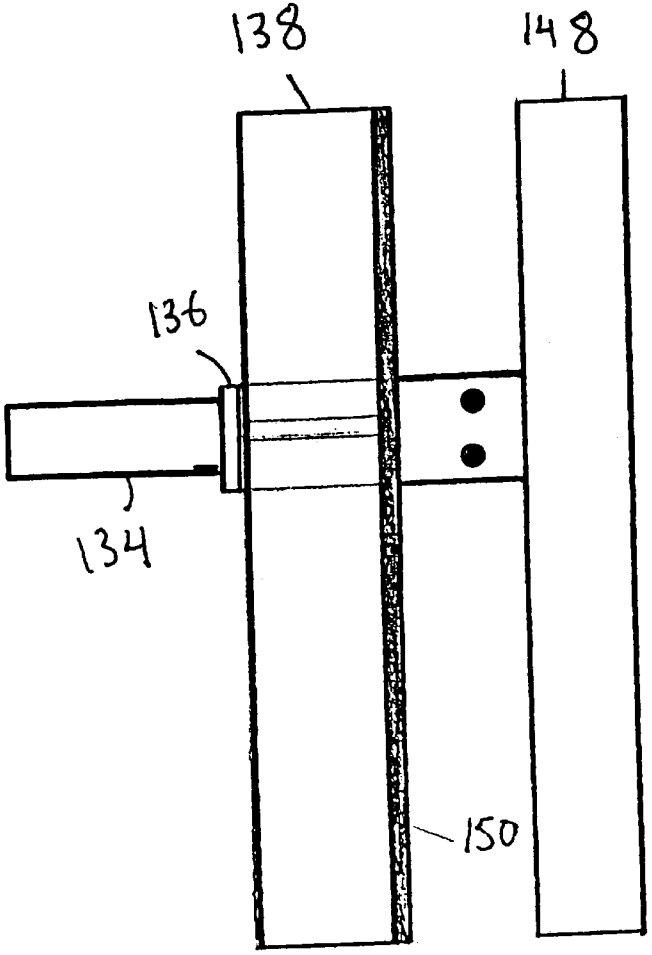

FIGS. 7A and 7B show the gripper assembly 130 in the open and closed positions, respectively. In FIG. 7A, an air cylinder 134, a gripper plate mount 136, a gripper plate 138 and angled gripper plate 148 are shown. The gripper plate 138 and angled gripper plate 148 are configured to be moved closer or further relative to one another to grab or grip pants. In the shown embodiment, the angled gripper plate 148 is rigidly mounted on the end of the gripper plate mount 136. The gripper plate 138 is slidably mounted to the gripper plate mount 136. The gripper plate 138 is affixed to the air cylinder 134 such that movement of the air cylinder causes the gripper plate 138 to slide along the gripper plate mount 136 closer or farther away from the angled gripper plate 148. Preferably, the gripper plate 138 is provided with a quantity of anti-skid tape 150 on the surface facing the angles gripper plate 148.

Method Of Operation

In use, a pair of pre-creased pants are slid over the supports 14 with the waist portion of the pants being closest to the base 12 and the cuffs being closest to the removal section 100. The creases of the pants are arranged to line up with the upper crease blade 20 and the lower crease blade 30. Because the left and the right lower crease blade 30 are moved independently, the left and right pant legs need not be positioned in precisely the same orientation.

To begin the operation, foot pedal 74 is pressed to activate the creasing section 10. Then the lower crease blade 30 is pivoted away from the user crease blade 20 until each leg of the pants is drawn taut and each of the nozzles 24 contacts the inside of the pant crease. This is accomplished by the air cylinders 60. Pressure is maintained by the air cylinder 60 to ensure that nozzles 24 remain in the pant crease.

The gear motor 112 is then activated and brings the hanger 120 and thereby the gripper 130 toward the pant cuffs. The gripper plate 138 and angled gripper plate 148 are arranged as shown in FIG. 7A with a gap to place the cuffs between these plates.

Thereafter, the gripper plate 138 and the angled gripper plate 148 are brought together as in FIG. 7B. The nozzles 24 are activated (i.e. the material regulator 54 permits a preselected amount of setting material to flow to the nozzles). Flow of resin to the upper and lower crease blades is independently controlled. The pair of pants is slid in an axial direction away from the creasing section 10 and toward the removal section 100. This is accomplished by the gear motor 112 which slides away from the creasing section 10 while maintaining its grip of the pant cuffs.

Once the gripper 130 moves the pants past the position of the photo eye, a signal is sent to release the pants (i.e., assume the configuration of FIG. 7A). This may be responsive to the activation of pedal 76 or it may be a function of a photo eye section 78 which detects the passing of, for example, the waistband of the pants.

The flow of setting material to the nozzles 24 may also be terminated. The flow of the resin to the nozzle of the upper crease blade may be ceased independently of the flow to the lower crease blade because at least two valves 24 are used. Optionally, four valves 24 are used and control to each of the two upper crease blades and the two lower crease blades are independently and coordinately supplied with a flow of resin material.

Further, this may also cause the lower crease blade 30 to return to its original position—move closer to the upper crease blade 20.

It will be apparent to those skilled in the art that modifications and variations can be made in the apparatus of this invention without departing from the scope of the invention. For example, creasing materials other than silicone rubber can be used by the apparatus described. The invention in its broader aspects is, therefore, not limited to the specific details and illustrated examples shown and described. Accordingly, it is intended that the present invention cover such modifications and variations, provided that they fall within the scope of the appended claims and their equivalents.

What is claimed is:

1. An apparatus comprising:

a base;

a pair of substantially horizontal parallel support members extending from the base;

an upper crease blade mounted to each of the support members;

an upper applicator nozzle mounted to each of the upper crease blades and connected to a supply of setting material;

a lower crease blade movably affixed via a mechanical assembly to each of the support member;

a lower applicator nozzle mounted to each of the lower crease blades and connected to the supply of setting material;

a pair of actuators connected to the mechanical assemblies, each of the actuators adapted to controllably move a one of the lower crease blades relative to the upper crease blades; and a controller adapted to coordinately control movement of the lower crease blades and supply of the setting material upon activation, and wherein each of the mechanical assemblies comprises a control arm having a near end and a far end in relation to the base, the lower crease blade being pivotally affixed to the control arm at the far end; the control arm being pivotally affixed to the horizontal support member at a pivot point between the near end and the far end, and wherein each of the actuators is connected to a one of the control arms at the near end and adapted to pivot the control arm about the pivot point.

2. The apparatus of claim 1, wherein a location of the pivot point is chosen so that a ratio of a distance between the far end and the pivot point to a length of the control arm is between about ⅓ and about ¾.

3. The apparatus of claim 2, wherein the ratio is about two-thirds (⅔).

4. The apparatus of claim 3, wherein the mechanical assembly is adapted to move the lower crease blade as a whole in a substantially downward direction.

5. The apparatus of claim 1, wherein each of the actuators comprises a pressure cylinder mounted on the base.

6. The apparatus of claim 5, wherein each of the pressure cylinders is an air cylinder.

7. The apparatus of claim 1, further comprising at least one valve associated with the controller and adapted to regulate the supply of resin to the applicator nozzles.

8. An apparatus comprising:

a base;

a pair of substantially horizontal parallel support members extending from the base;

an upper crease blade mounted to each of the support members;

an upper applicator nozzle mounted to each of the upper crease blades and connected to a supply of setting material;

a lower crease blade movably affixed via a mechanical assembly to each of the support member;

a lower applicator nozzle mounted to each of the lower crease blades and connected to the supply of setting material;

a pair of actuators connected to the mechanical assemblies, each of the actuators adapted to controllably move a one of the lower crease blades relative to the upper crease blades;

a controller adapted to coordinately control movement of the lower crease blades and supply of the setting material upon activation; and at least two valves associated with the controller and adapted to regulate the supply of resin to the applicator nozzles, each of the valves being adapted to independently control the supply of the setting material to a one of the upper applicator nozzles or a one of the lower applicator nozzles.

9. The apparatus of claim 1, further comprising a sensor associated with the controller adapted to detect the presence of a pair of pants on the support member and to detect the passing of a waistband the pair of pants.

10. The apparatus of claim 9, wherein the sensor is a photo eye mounted on a sensor support affixed to the horizontal support member.

11. The apparatus of claim 1, wherein at least one of the upper applicator or the lower applicator nozzles has the shape of an elongated oval.

12. The apparatus of claim 1, wherein at least one of the upper crease blades has a straight top edge.

13. The apparatus of claim 1, further comprising a pant removal section including (1) a support frame having a near end closest to the base and a far end further away from the base, (2) a trolley assembly including a slider block associated with the support frame and adapted for reciprocal movement along a guide rail in a predetermined path, (3) a pair of grippers attached to the trolley, and (4) a controller adapted to coordinately control movement of the trolley assembly and actuation of the gripper, and supply of the setting material to the upper and lower applicator nozzles.

14. The apparatus of claim 13, further comprising at least one manually-operated switch associated with the controller and adapted to activate the controller once a pair of pants are placed over the horizontal support members.

15. The apparatus of claim 14, wherein the manually operated switch is a foot switch.

16. The apparatus of claim 14, further comprising at least one magnetic reed switch associated with the controller and located along the guide rail and adapted to detect the location of the trolley assembly.

17. The apparatus of claim 13, wherein each of the grippers comprises:

a pair of U-shaped brackets mounted on the trolley, each bracket having a short leg and a long leg;

an air cylinder mounted between the short legs and long legs of the pair of U-shaped brackets, the air cylinder being affixed to the short legs of the pair of U-shaped brackets, the cylinder including a push rod which defines an axis perpendicular to the axis of the long legs of the U-shaped brackets; and a plate mounted on the push rod and defining a plane parallel to a plane defined by the long legs of the pair of U-shaped brackets;

wherein, upon activation, the push rod is adapted to move along the perpendicular axis.

18. An apparatus comprising:

a base;

a pair of substantially horizontal parallel support members extending from the base;

an upper crease blade mounted to each of the support members;

an upper applicator nozzle mounted to each of the upper crease blades and connected to a supply of setting material;

a lower crease blade movably affixed via a mechanical assembly to each of the support member;

a lower applicator nozzle mounted to each of the lower crease blades and connected to the supply of setting material;

a pair of actuators connected to the mechanical assemblies, each of the actuators adapted to controllably move a one of the lower crease blades relative to the upper crease blades;

a controller adapted to coordinately control movement of the lower crease blades and supply of the setting material upon activation; and a pant removal section including (1) a support frame having a near end closest to the base and a far end further away from the base, (2) a trolley assembly including a slider block associated with the support frame and adapted for reciprocal movement along a guide rail in a predetermined path, (3) a pair of grippers attached to the trolley, and (4) a controller adapted to coordinately control movement of the trolley assembly and actuation of the gripper, and supply of the setting material to the upper and lower applicator nozzles, wherein the trolley assembly comprises a DC gear motor mounted to the support frame including a drive shaft having a first pulley mounted thereon;

a second pulley mounted on the support frame;

a toothed belt suspended between the first pulley and the second pulley; and a support block affixed to the toothed belt upon which the gripper is attached.

19. The apparatus of claim 18, wherein first pulley is arranged with respect to the second pulley so that the belt defines a plane with a downward slope.

20. The apparatus of claim 18, wherein first pulley is arranged with respect to the second pulley so that the belt defines a generally horizontal plane.

* * * * *